United States Patent [19]

Färber

[11] Patent Number: 4,801,073

[45] **Date of Patent: * Jan. 31, 1989**

[54] LIQUID PACKAGING CONTAINER WITH A FILMED-OVER NOTCH

[75] Inventor: Jürgen Färber, Kaarst, Fed. Rep. of Germany

[73] Assignee: PKL Papier- und Kunstoff Werke Linnich GmbH, Dusseldorf, Fed. Rep. of Germany

[ * ] Notice: The portion of the term of this patent subsequent to Mar. 1, 2005 has been disclaimed.

[21] Appl. No.: 127,526

[22] Filed: Dec. 1, 1987

Related U.S. Application Data

[63] Continuation of Ser. No. 58,969, Jun. 8, 1987, abandoned, which is a continuation of Ser. No. 355,031, Mar. 5, 1982, Pat. No. 4,728,024.

[30] Foreign Application Priority Data

Apr. 1, 1981 [DE] Fed. Rep. of Germany ..... 3113044

[51] Int. Cl.[4] ..... B65D 5/62

[52] U.S. Cl. ..... 229/3.1; 229/48 T; 229/184

[58] Field of Search ..... 229/184, 125.42, 138, 229/3.1, 48 SC, 48 T

[56] References Cited

U.S. PATENT DOCUMENTS 3,412,922 11/1968 Miller et al. ..... 229/176
3,421,678 1/1969 Thompson et al. ..... 229/3.1
3,913,825 10/1975 Brownlee et al. ..... 229/184
3,913,826 10/1975 Brownlee et al. ..... 229/184
3,942,708 3/1976 Christensson ..... 229/48 T X
4,728,024 3/1988 Farber ..... 229/3.1

FOREIGN PATENT DOCUMENTS 1761225 4/1971 Fed. Rep. of Germany .

*Primary Examiner*—Stephen Marcus
*Assistant Examiner*—Bryon Gehman
*Attorney, Agent, or Firm*—Sprung Horn Kramer & Woods

[57] ABSTRACT

In a die-cut cardboard blank coated on at least one side with plastic and/or aluminum foil and capable of being folded into a liquid packaging container having a planar, rectangular folded bottom sealed in a liquid-tight manner with an overlapped seam and a protected edge on the inner bottom fold-in panel, the improvement which comprises providing the blank with an inner bottom fold-in panel having in its marginal area a die-cut notch extending beyond the visible area when folded, this notch being filmed over with the coating material. Alternatively, the blank may be provided with an inner bottom and triangular fold flaps, the triangular fold flaps having tips which in folded condition abut one another and cover the inner bottom fold-in panel, the tips being die-cut and filmed over with coating material.

4 Claims, 2 Drawing Sheets

LIQUID PACKAGING CONTAINER WITH A FILMED-OVER NOTCH

This application is a continuation of application Ser. No. 058,969, filed June 8, 1987, now abandoned, which is continuation of application Ser. No. 355,037, filed Mar. 5, 1982, now issued as U.S. Pat. No. 4,728,024.

BACKGROUND

The invention relates to a liquid packaging container, especially in oblong form, which is formed by folding a die-cut cutboard blank coated on one or both sides with plastic and/or duplexed to aluminum foil, having a planar, rectangular folded bottom sealed in a liquid-tight manner with an overlapped seam and a protected edge on the inner-lying bottom fold-in panel.

Liquid packaging containers of coated cardboard are made with a folding bottom with overlapped seam or with a folded bottom with a laid-flat joining seam. Folded bottoms with overlapped seam are indeed less expensive both in consumption of material and in the apparatus required for folding and sealing, but on the other hand they have at least one open cut edge in contact with the contents, and this is not acceptable for certain kinds of filling, such as filling with hot liquids, aseptic filling and gas-tight filling.

Overlapped-seam packaging containers are known from DE-AS 17 61 255, in which two notches are provided in the bottom tuck-in panel, which define a backfolding area which is folded over with its front edge reaching past the axis of symmetry of the bottom. In this known arrangement, however, the backfolding area in the neighborhood of the bottom seam produces a bulge making the bottom surface uneven and can lead to leaks by the formation of a channel. Also, this arrangement is limited to folded bottoms having tuck-in panels.

THE INVENTION

It is the object of the invention to create a more reliable protection for bottom edges in overlapped-seam, folded-bottom packaging containers.

This is achieved in one embodiment in accordance with the invention in that the inner bottom fold-in panel has in the marginal area a die-cut notch extending beyond the visible portion, which notch is filmed over by the coating material.

This has the advantage that an additional layer is not formed as it is in the solution known from DE-AS 17 61 255 by the folding over of the backfolding area.

In the area of the tip of the triangular fold flaps, an additional notch or die-cut recess can preferably be provided, which is filmed over with the coating material. This solutin offers itself whenever, on account of a lack of a clean folding, no "crumpling over" of the tip of the triangular fold flaps takes place, but also when the tips are very close together or even partially overlap, and thus the danger generally exists that no edge protection is formed in the area of the tips of the triangles.

In accordance with another embodiment of the invention, provision is made in a liquid packaging container such that the abutting tips of the triangular fold flaps, which contact one another and cover the inner bottom fold-in panel, are die-cut and the cut-out portions are filmed over with coating material.

By the pile-up of coating material, especially extruded plastic such as polyethylene, additional material is made available in the window formed by the die cut in the inner bottom fold-in panel and/or at the tips of the triangular fold flaps, and it can flow into channels and plug them in the hot sealing process, i.e., the coating material filmed over the notch directly contacts coating material on the adjacent panels.

The shape of the die cut can be any desired shape. It can be half-round, triangular or quadrangular, and should be adapted to the folding in the bottom area.

The invention will be further described with reference to the accompanying drawings, wherein FIGS. 1 to 5 represent different embodiments of blanks and cartons in accordance with the invention, (a) in each Figure constituting a view of the bottom of the folded carton from inside the carton, and (b) the bottom portions of the corresponding die-cut blank.

FIG. 1 shows a standard bottom with inside panel 1 and outside panel 2, as well as the triangular fold panels 3 and 4. A die-cut notch 5 is made in the margin of the inner bottom fold-in panel 1, and is filmed over with the coating material 6, preferably plastic. The edge of the inner bottom fold-in panel 1 is thus protected. The length of the notch or recess 5 is such that it extends slightly past the visible portion between the triangular folding flaps 3 and 4, as can be seen in FIG. 1*a*.

The embodiment in FIG. 2, economy bottom with outside panel, differs in the round shape of the filmed-over die cut, which is also designated by the reference number 5, just as identical parts are provided with the same reference numbers in this and the rest of the Figures.

In the embodiment shown in FIG. 3, an economy bottom with outside panel and overlapping or nonoverlapped tips of the triangular fold flaps 3, 4, only the tips of the triangular fold flaps 3 and 4 are provided with die-cuts or notches 7, 8, which are filmed over with coating material 9. The edge 10 of inner inner-lying bottom fold-in panel 1 is covered by the coating material of the tips and thus protected.

Figure 1A:
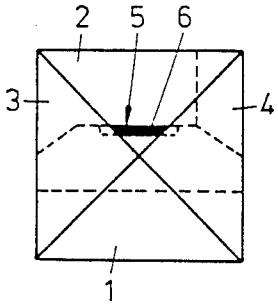
Figure 1B:
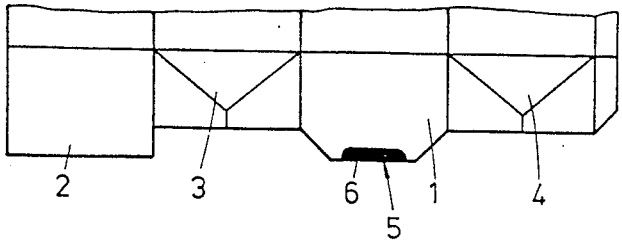
Figure 2A:
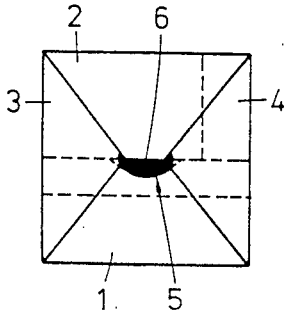
Figure 2B:
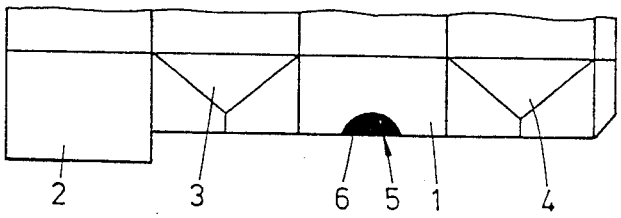
Figure 3A:
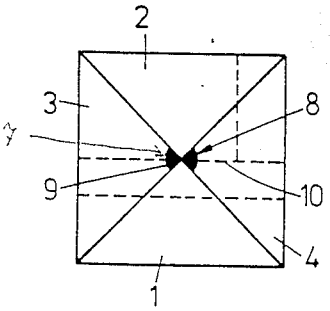
Figure 3B:
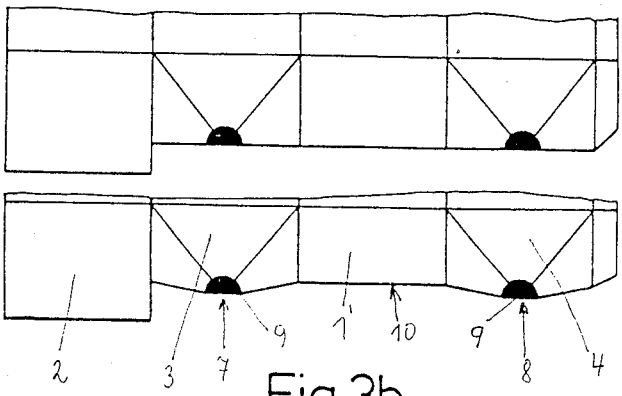
Figure 4A:
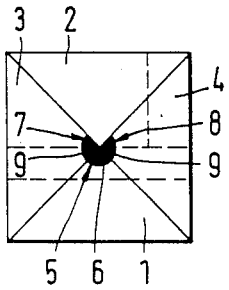
FIG. 4 shows an economy bottom with outside panel in an embodiment combining FIGS. 2 and 3.
Figure 4B:
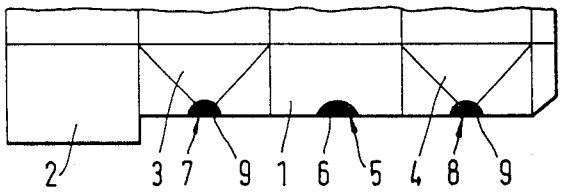
Figure 5A:
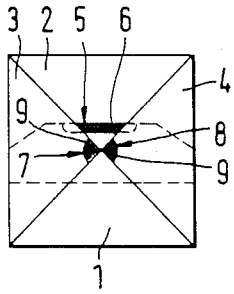
FIG. 5 shows a standard bottom in the embodiment shown in FIG. 1, but having additional notches 7, 8 in the area of the tips of the triangular fold flaps 3, 4, in a manner like that of the embodiment represented in FIG. 3.
Figure 5B:
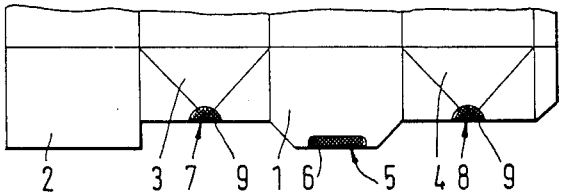

It will be understood that the specification and examples are illustrative but not limitative of the present invention and that other embodiments with the spirit and scope of the invention will suggest themselves to those skilled in the art.

What is claimed is:

1. In a die-cut cardboard blank coated on both sides with a thermoplastic coating and capable of being folded into a liquid packaging container having a planar rectangular folded bottom sealed in a liquid-tight manner with an overlapped seam and a protected edge on the inner bottom fold-in panel, the improvement which comprises providing the blank with an inner bottom fold-in panel having in its marginal area a die-cut notch extending beyond the visible area when folded, this notch being entirely filmed over with the coating material of the blank, whereby the coating material filmed over the notch directly contacts coating material on the adjacent panels.

2. A blank according to claim 1, provided with triangular fold flaps having tips which are die-cut and filmed over with coating material.

3. A container formed by folding and sealing a blank according to claim 1.

4. A container formed by folding and sealing a blank according to claim 2.

* * * * *